United States Patent [19]

Eklöf

[11] 4,413,687

[45] Nov. 8, 1983

[54] HYDRAULICALLY OPERATED IMPACT DEVICE

[75] Inventor: Ake T. Eklöf, Skärholmen, Sweden

[73] Assignee: Atlas Copco Aktiebolag, Nacka, Sweden

[21] Appl. No.: 234,444

[22] Filed: Feb. 13, 1981

[30] Foreign Application Priority Data

Feb. 20, 1980 [SE] Sweden ..... 8001325

[51] Int. Cl.[3] ..... B25D 9/18

[52] U.S. Cl. ..... 173/134; 91/278

[58] Field of Search ..... 173/116, 134, 135, 137; 91/277, 278, 279

[56] References Cited

U.S. PATENT DOCUMENTS

| | | | |
|---|---|---|---|
| 645,582 | 3/1900 | Watson | 91/278 X |
| 909,923 | 1/1909 | Mitchell | 91/278 X |
| 1,946,548 | 2/1934 | Shaff | 173/134 X |
| 2,100,541 | 11/1937 | Gartin | 173/134 X |
| 3,552,269 | 1/1971 | Arndt | 91/278 X |
| 3,780,621 | 12/1973 | Romell | 91/278 X |
| 4,034,817 | 7/1977 | Okada | 173/134 |
| 4,172,411 | 10/1979 | Matsuda et al. | 91/278 |
| 4,349,075 | 9/1982 | Henriksson | 173/134 |

FOREIGN PATENT DOCUMENTS

| | | |
|---|---|---|
| 10532 | 4/1980 | European Pat. Off. . |
| 1550520 | 8/1979 | United Kingdom . |

*Primary Examiner*—Frederick R. Schmidt
*Assistant Examiner*—Robert P. Olszewski
*Attorney, Agent, or Firm*—Frishauf, Holtz, Goodman & Woodward

[57] ABSTRACT

In a hydraulic rock drill the valve (27) is controlled by two control lines (37, 42), each control line having a plurality of branches with ports (38–41 and 43–46) which open into the hydraulic cylinder of the rock drill.

A valving pin (48) is slidable in a bore that intersects all of the branches of both control lines. By axially displacing the pin, the operator can pre-select the stroke length by deactivating some of the control lines and thereby the impact energy per blow. The control lines are deactivated in a predetermined bound relationship to each other.

14 Claims, 3 Drawing Figures

HYDRAULICALLY OPERATED IMPACT DEVICE

This invention relates to a hydraulically operated impact device, for example a rock drill, comprising a housing, a cylinder in the housing, an anvil means, a hammer piston which is reciprocably mounted in said cylinder and arranged to impact upon said anvil means, and port means in said cylinder cooperating with the hammer piston in order to control the reciprocation of the hammer piston and initiate the work stroke when the hammer piston reaches a predetermined variable rear position during its return stroke and initiate the return stroke when the hammer piston reaches a variable forward position during its work stroke.

In British Patent Specification No. 1,550,520, such a hydraulic impact device is described that has two sets of ports. The sets of ports are used independently of each other to vary the impact energy. The selection of ports of one of the sets is used to vary the stroke length and the selection of ports of the other set is used to vary the effective length of a work stroke, i.e. to retard the piston during a selected end portion of the work stroke.

SUMMARY OF THE INVENTION

It is an object of the present invention to provide for a simple and efficient selection of the impact energy. This is achieved mainly by the provision of means for simultaneously varying the predetermined forward and rear positions defined above in a bound relationship. By this arrangement, the stroke length can be easily varied and the piston can be accelerated during its entire work stroke independently of the selected stroke length. As a result, the impact device maintains a high rate of efficiency when the stroke length is varied.

DETAILED DESCRIPTION

Figure 1:
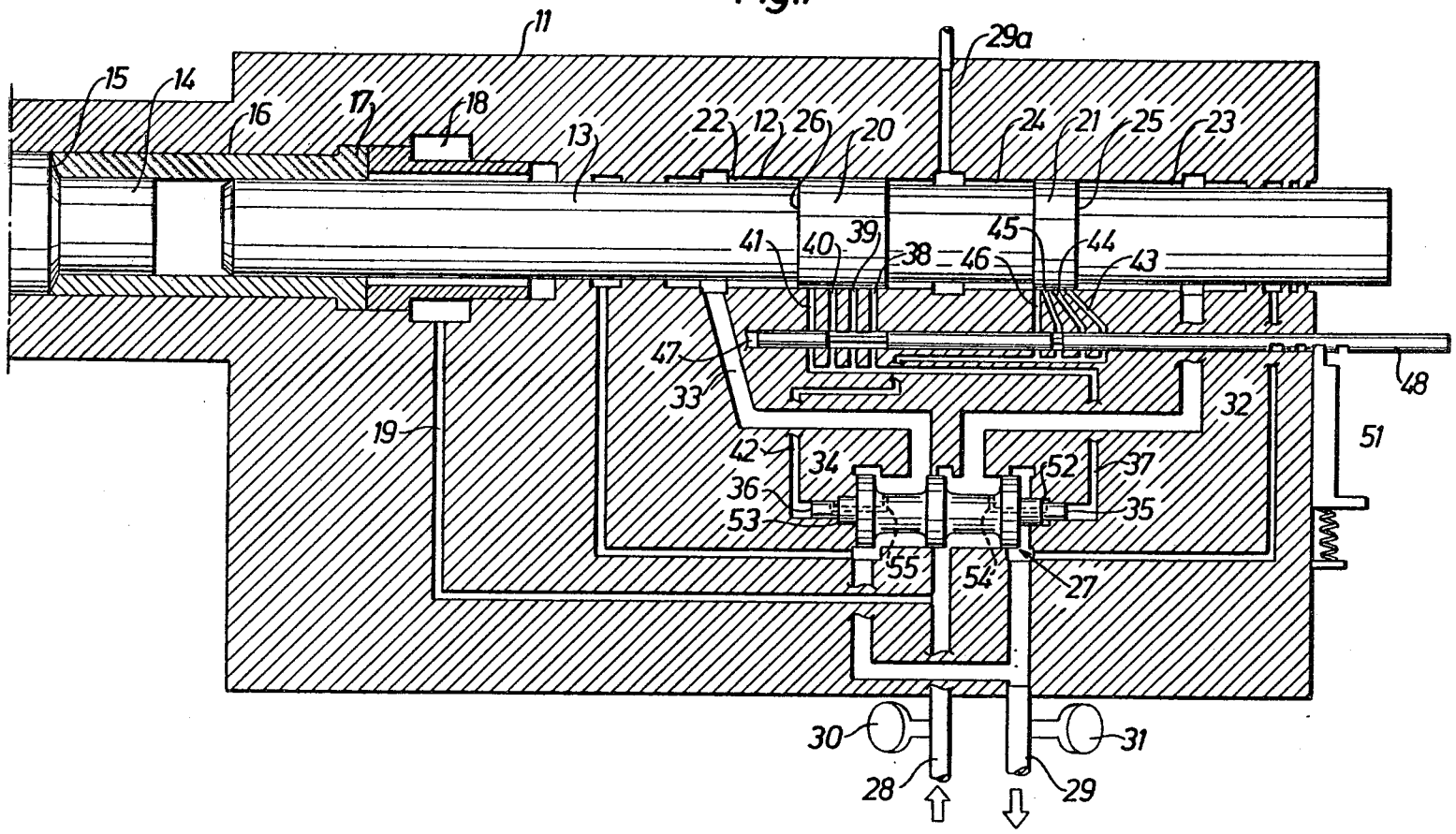
FIG. 1 is a schematic longitudinal section through a hydraulic jack hammer or rock drill according to the invention.

The impact device shown in FIG. 1 is a hydraulic rock drill, a hydraulic jack hammer or the like. It comprises a housing 11 forming a cylinder 12 in which a hammer piston 13 is reciprocable to impact upon an anvil element 14, for example a chisel, a rock drill stem or an adapter for a rock drill stem. A shoulder 15 on the anvil element takes support on a sleeve 16 that abuts against a recoil damping piston 17. The damping piston 17 is forced forwardly into its foremost position as shown by the hydraulic pressure in a cylinder chamber 18 that is constantly pressurized through a passage 19. The hammer piston 3 has two lands 20, 21 so that a front cylinder chamber 22, a rear cylinder chamber 23 and an intermediate cylinder chamber 24 are formed between the piston 13 and the cylinder 12. The piston 13 is driven forwardly by the pressure acting on its surface 25 and driven rearwardly by the pressure acting on its surface 26. A valve 27 is connected to an inlet 28 coupled to a source of high pressure hydraulic fluid and to an outlet 29 coupled to tank. Accumulators 30, 31 are coupled to the inlet 28 and the outlet 29. The intermediate cylinder chamber 24 is constantly connected to the outlet 29 by means of a passage **29*a*. The valve 27 is coupled to the rear cylinder chamber 23 by means of a supply passage 32 and to the front cylinder chamber 22 by means of a supply passage 33. The valve 27 has a valving spool 34 which in its illustrated position connects the rear cylinder chamber 23 to pressure and the front cylinder chamber 22 to tank. The spool 34 has cylindrical end portions 35, 36, the end faces of which have piston surfaces that are subject to the pressure in control passages 37, 42 that each are branched into four branches so that they each have four ports 38, 39, 40, 41 and 43, 44, 45, 46 respectively into the cylinder 12. A cylindrical bore 47 intersects all eight branches and a cylindrical pin 48 is slidable with a tight fit in the bore 47. This pin 48 has two recesses 49, 50 and it can be positively locked in four defined axial positions by means of a lock bolt 51**.

The operation of the impact device of FIG. 1 will now be described.

The hammer piston 13 is shown in FIG. 1 moving forwardly in its work stroke (to the left in FIG. 1), and the valve spool 34 is then in its illustrated position. When the port 45 of the control passage 42 is opened to the rear cylinder chamber 23, the control passage 42 will convey pressure to the control piston 36 so that the valve spool 34 is moved to the right in FIG. 1. The valve spool 34 should preferably finish its movement at the very moment the hammer piston 13 impacts upon the anvil 14. Thus, the pressure existing from the moment of impact in the front cylinder chamber 22 moves the hammer piston 13 rearwardly until the branch 40 of the control passage 37 is opened to the front pressure chamber 22. Then, the control passage 37 conveys pressure to the control piston 35 which moves the valve spool 34 back to its illustrated position so that the rear cylinder chamber 23 is again pressurized. The pressure in the rear cylinder chamber 23 retards the hammer piston 13 and accelerates it forwardly again so that the hammer piston 13 performs another work stroke.

The valve spool 34 has annular surfaces 52, 53 and internal passages 54, 55 which hold the valve spool in position during the periods when the control pistons 35, 36 do not positively hold the piston. The annular surfaces 52, 53 are smaller than the end faces of the pistons 35, 36.

When the pin 48 is in its illustrated position, the port 40 of the control passage 37 and the port 45 of the control passage 42 are the ports that make the valve spool shift position. The other ports are inactivated. In the other three positions of the pin 48 one pin of the three pairs of ports 38, 43; 39, 44 and 41, 46 respectively is selected to cooperate to control the valve.

The first one of the ports 38–41 that is opened to the front cylinder chamber 22 during the return stroke of the hammer piston initiates the valve spool 34 to shift position. Thus, by adjusting the axial position of the pin, the operator pre-selects the stroke length of the hammer piston. The axial distances between the ports 43–46 are smaller than the corresponding distances between the ports 38–41. The axial positions of the ports 43–46 in the cylinder are such that for each stroke length the selected one of the ports 43–46 is uncovered a distance before the impact position of the hammer piston, and the distance is such that the valve spool has just moved to its position for pressurizing the front pressure chamber when the hammer piston 13 impacts the anvil 14. If the pump pressure is constant, the selected port is uncovered the same period of time before impact occurs independently of which one of the four ports is selected.

Figure 2:
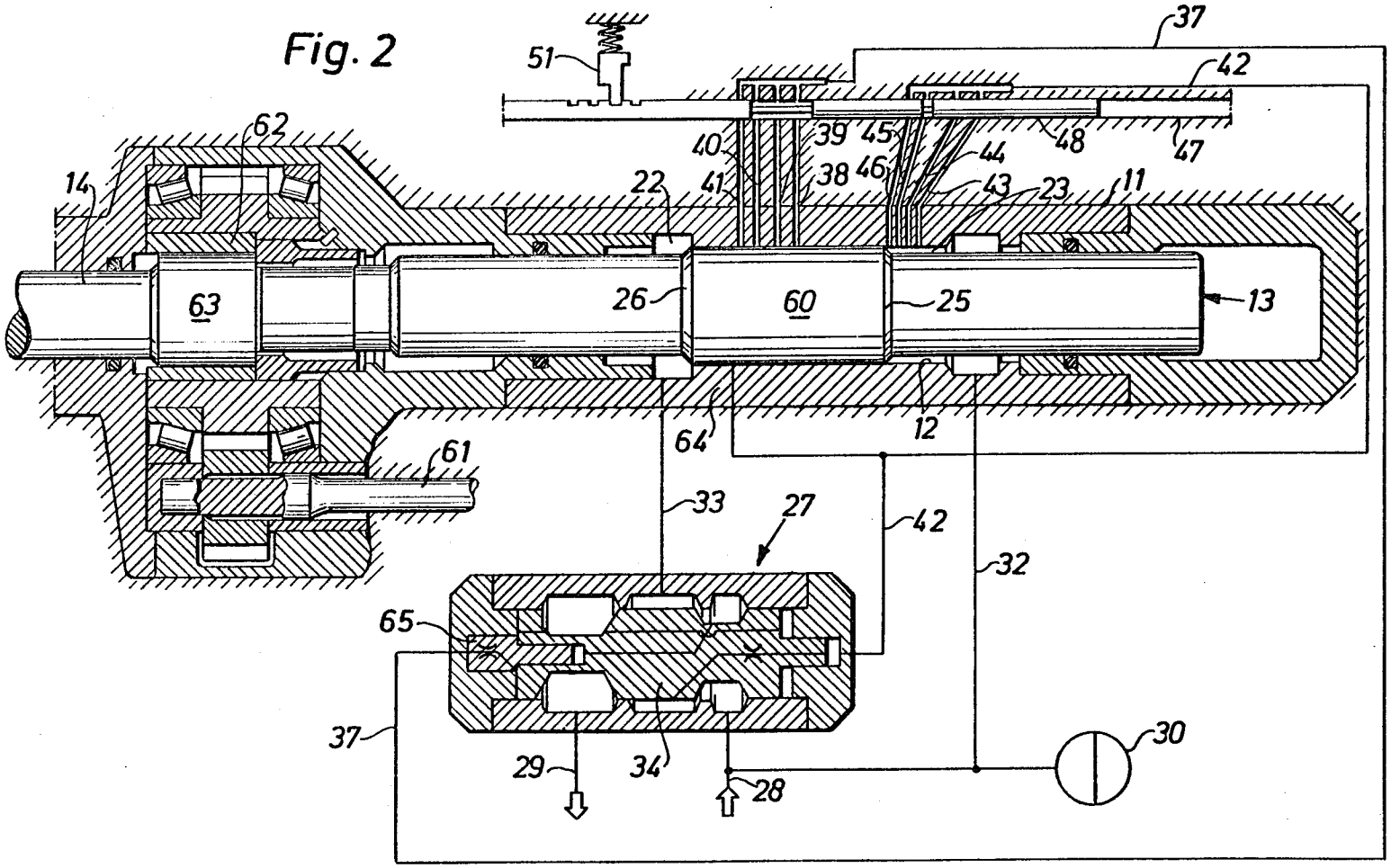
FIG. 2 is a schematic longitudinal section through another rock drill according to the invention.

In FIG. 2, a rock drill is shown that has a hammer piston 13 with a single land 60. A shaft 61 is rotated by a non-illustrated hydraulic motor and coupled to rotate a chuck bushing 62. The drill steel adapter 14 has a non-circular widened portion 63 which engages with the chuck bushing 62 to rotate conjointly with the latter. The adapter 14 and other details that correspond to details in FIG. 1 have been given the same reference numerals in FIG. 2 as in FIG. 1, as for example the valve 27, the control passages 37, 42 and their branches with ports 38–41 and 43–46 respectively, the pin 48 and the supply passages 32, 33 to the front cylinder chamber 22 and to the rear cylinder chamber 23. The supply passage 32 is in this embodiment not controlled by the valve 27, but it is constantly pressurized from the inlet 28. The piston surface 26 is larger than the piston surface 25. The piston 13 is moved forwardly by the pressure acting on the surface 25 and it is moved rearwardly by the pressure acting on the differential area of the surfaces 26 and 25. Since, in contrast to FIG. 1, there is no intermediate cylinder chamber, the valve 27 is somewhat more complicated and the control passage 42 has another branch with a port 64 into the cylinder. The valve 27 has a plunger 65 that is separate from the valve spool 34.

The operation of the valve 27 will not be described, but reference is made to European Patent Application No. 79850095.5 (corresponding to European publication No. 0 010 532, and to U.S. Application Ser. No. 85,409, now U.S. Pat. No. 4,349,075 which is incorporated herein by way of reference and which describes the operation of the valve in detail.

Figure 3:
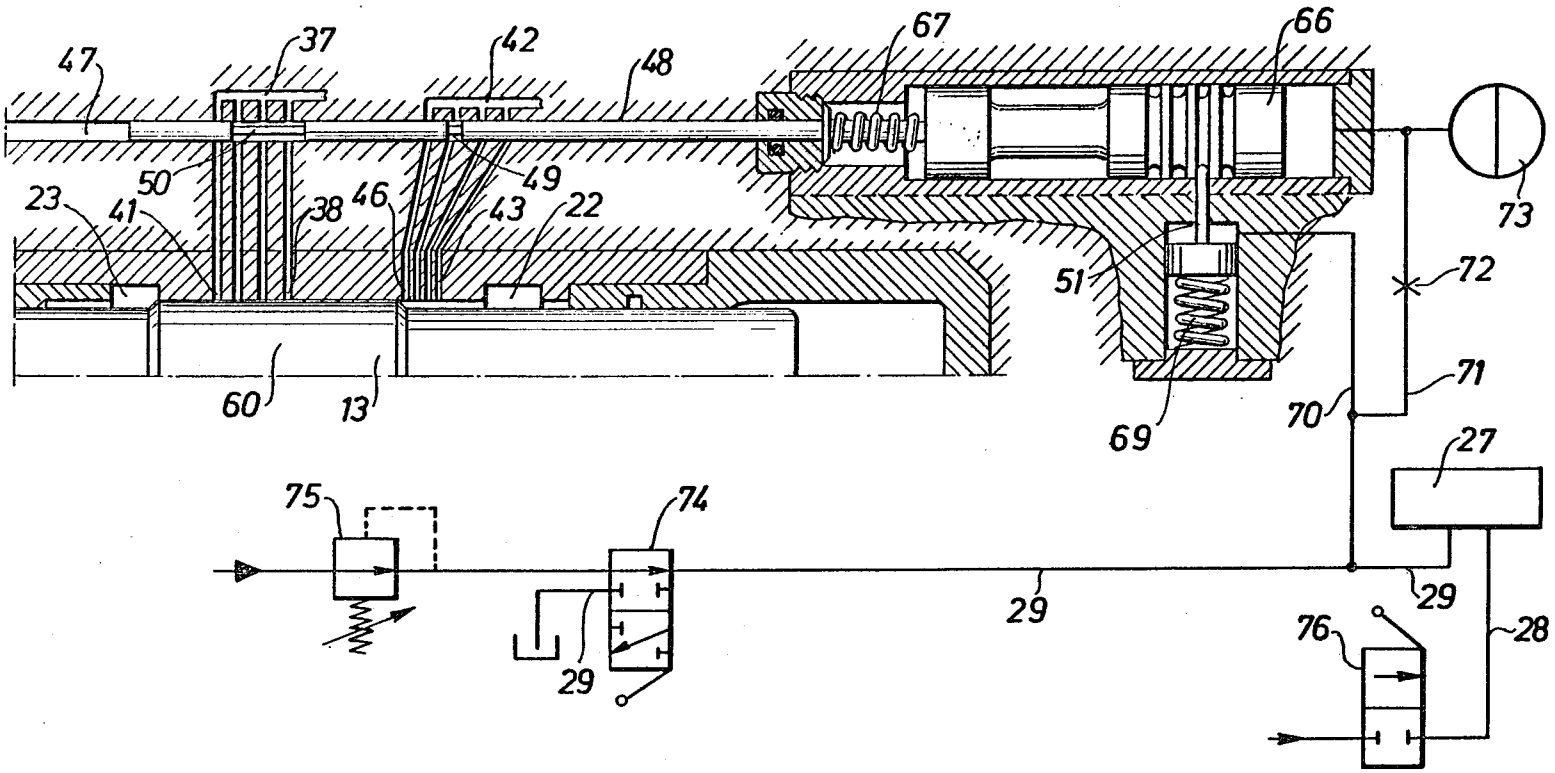
FIG. 3 is a fragmentary longitudinal view showing an alternative design of a selector pin shown in FIG. 2 and an actuation device for the pin.

In FIG. 2, the pin 48 is manually controlled, as in FIG. 1, but in FIG. 3 an alternative design is shown, in which the pin 48 is hydraulically remote controlled. On the end of the pin there is a piston 66 which is biassed to the right in FIG. 3 by means of a spring 67.

In FIG. 3, there is shown that there need not be a separate control line but that the outlet line 29 leading to tank can be used to convey the control pressure. This outlet line 29 can be pressurized through the pressure regulator 75. It is of course not possible to select the stroke length during drilling when the control system according to FIG. 3 is used, but it is usually not desirable to make the selection during drilling.

A valve 74 in the outlet line 29 holds normally the outlet line 29 open to tank, but it has an alternative position in which it is shown in FIG. 3. In this alternative position it connects a pressure regulator 75 to the outlet line 29. The pressure regulator 75 is coupled to the pump pressure. When the operation of the drill is interrupted and the valve 74 is shifted to its illustrated position, the lock pin 51 is released and the pressure from the pressure regulator 75 moves the piston 66 and thereby the selector pin 48 into an axial position in which the hydraulic pressure on the piston 66 balances the spring force. By manual adjustment of the pressure regulator 75, the axial position can be pre-selected. Then, when the valve 74 is switched back into its other position, the lock pin 51 moves into its position in which it positively locks the selector pin 48. In the inlet line 28, there is a manually operated supply valve 76.

As described with reference to FIG. 3, the outlet line 29 is used as a remote control line and the valve 74 and the pressure regulator 75 can be located at the operator's panel. Alternatively, a separate remote control line can of course be used and other remote control systems than the illustrated one can be used. It is, however, advantageous to reduce the number of lines leading to the rock drill.

There are prior art hydraulic rock drills that have a single control line instead of two control lines, as in the described embodiments. The invention can easily be applied to such designs and to most other designs of hydraulic percussive devices and it is not limited to the illustrated embodiments.

I claim:

1. In a hydraulically operated impact device, for example a rock drill, comprising a housing (11); a cylinder (12) in said housing; an anvil means (14); a hammer piston (13) which is reciprocably mounted in said cylinder and arranged to impact upon said anvil means; and first and second port means (38–41; 43–46) in said cylinder cooperating with said hammer piston for controlling the reciprocation of said hammer piston, said first port means being arranged for initiating the work stroke when said hammer piston reaches a predetermined variable rear position during its return stroke and said second port means being arranged for initiating the return stroke when said hammer piston reaches a variable forward position during its work stroke, the improvement comprising:

first means for selectively varying the working fluid flow through said first port means so as to provide for stroke length selection, the second means for selectively varying the working fluid flow through said second port means, said first and second means being operatively coupled together for selectively varying said working fluid flow through said first and second port means in a predetermined bound relationship.

2. In a hydraulically operated impact device, for example a rock drill, comprising a housing (11); a cylinder (12) in said housing; an anvil means (14); a hammer piston (13) which is reciprocably mounted in said cylinder and arranged to impact upon said anvil means; and first and second pluralities of ports (38–41; 43–46) in said cylinder cooperating with said hammer piston for controlling the reciprocation of said hammer piston, said first plurality of ports being arranged for initiating the work stroke when said hammer piston reaches a predetermined variable rear position during its return stroke and said second plurality of ports being arranged for initiating the return stroke when said hammer piston reaches a variable forward position during its work stroke, the improvement comprising:

first means for selectively inactivating at least one of the ports of said first plurality of ports so as to provide for stroke length selection, and second means for selectively inactivating at least one of the ports of said second plurality of ports, said first and second means being operatively coupled together for selectively inactivating said ports of said first and second pluralities of ports in a predetermined bound relationship.

3. Impact according to claim 2, wherein said first and second means selectively and simultaneously inactivate at least one of both said first and second pluralities of ports in said predetermined bound relationship.

4. In a hydraulically operated impact device, for example a rock drill, comprising a housing (11); a cylinder (12) in said housing; an anvil means (14); a hammer piston (13) which is reciprocably mounted in said cylinder and arranged to impact upon said anvil means; and inlet (28) for hydraulic pressure fluid; an outlet (29) for hydraulic fluid; at least one first port and at least one second port (38–41; 43–46) in said cylinder cooperating with said hammer piston for controlling the reciprocation of said hammer piston, said at least one first port being arranged for initiating the work stroke when said hammer piston reaches a predetermined variable rear position during its return stroke and said at least one second port being arranged for initiating the return stroke when said hammer piston reaches a variable forward position during its work stroke, the improvement comprising:

a valve (27) coupled to said inlet (28) and to said outlet (29);

said at least one first port (38–41) in said cylinder being coupled to effect a shift-over of said valve (27) to a first position in response to the axial position of said hammer piston for effecting the work stroke of said hammer piston when said hammer piston reaches a predetermined variable rear position during its return stroke, and said at least one second port in said cylinder being coupled to effect a shiftover of said valve (27) to a second position in response to the position of said hammer piston for effecting the return stroke of said hammer piston when said hammer piston reaches a predetermined variable forward position during its work stroke; and first means for selectively restricting the working fluid flow through said at least one first port so as to provide for stroke length selection, and second means for selectively restricting the working fluid flow through said at least one second port, said first and second means being operatively coupled together for selectively restricting said working fluid flows in a predetermined bound relationship.

5. In a hydraulically operated impact device, for example a rock drill, comprising a housing (11); a cylinder (12) in said housing; an anvil means (14); a hammer piston (13) which is recirocably mounted in said cylinder and arranged to impact upon said anvil means; an inlet (28) for hydraulic pressure fluid; an outlet (29) for hydraulic fluid; and first and second pluralities of ports (38–41; 43–46) in said cylinder cooperating with said hammer piston for controlling the reciprocation of said hammer piston, said first plurality of ports being arranged for initiating the work stroke when said hammer piston reaches a predetermined variable rear position during its return stroke and said second plurality of ports being arranged for initating the return stroke when said hammer piston reaches a variable forward position during its work stroke, the improvement comprising:

a valve (27) coupled to said inlet (28) and to said outlet (29);

said first plurality of ports (38–41) in said cylinder being coupled to initiate a shift-over of said valve (27) to a first position in response to the axial position of said hammer piston for effecting the work stroke of said hammer piston when said hammer piston reaches a predetermined variable rear position during its return stroke, and said second plurality of ports in said cylinder being coupled to effect a shift-over of said valve (27) to a second position in response to the position of said hammer piston for effecting the return stroke of said hammer piston when said hammer piston reaches a predetermined variable forward position during its work stroke and first means for selectively inactivating at least one of the ports of said first plurality of ports so as to provide for stroke length selection, and second means for selectively inactivating at least one of the ports of said second plurality of ports, said first and second means being operatively coupled together for selectively inactivating said ports of said first and second pluralities of ports in a predetermined bound relationship.

6. Impact device according to claim 5, wherein said housing includes a bore (47) and passages leading to said first and second pluralities of ports; said first means for selectively inactivating at least one of said ports of said first plurality of ports (38–41) comprising a first valving element (48–50) slidable in said bore (47) in said housing for selectively blocking said passages leading to said first plurality of ports; and said second means for selectively inactivating at least one of said plurality of said secnd plurality of ports comprising a second valving element (48,49) slidable in said bore (47) for selectively blocking passages leading to said second plurality of ports; said first and second valving elements being conjointly displaceable in said bore (47).

7. Impact device according to claim 6 wherein said first and second valving elements (48–50) are integral with each other.

8. Impact device according to any one of claims 5, 6 or 7, wherein the axial distances between consecutive ones of said ports of said second plurality of ports (43–46) are smaller than the axial distances between corresponding ones of said ports of said first plurality of ports (38–41).

9. Impact device according to claim 8, wherein the axial positions of said ports of said second plurality of ports (43–46) in said cylinder are arranged such that the port selected to signal said valve (27) to shift over to said second position is opened so as to signal shift-over at substantially the same period of time before impact occurs regardless of which one of the ports being selected.

10. Impact device according to claim 9, wherein said hammer piston (13) has a first drive surface (26) in a front pressure chamber (22) for effecting the return stroke and a second drive surface (25) in a rear pressure chamber (25) for effecting the impact stroke, said port of said first plurality of ports (38–41) being located to be opened to said front pressure chamber (22) when said first drive surface (26) passes said ports of said first plurality of ports during the return stroke of the hammer piston, and said ports of said second plurality of ports (43–46) being located to be opened to said rear pressure chamber (23) when said second drive surface (25) passes said ports of said second plurality of ports during the impact stroke of the hammer piston.

11. Impact device according to claim 8, wherein the axial positions of said ports of said second plurality of ports (43–46) in the cylinder are arranged such that each port when selected to cause said valve (27) to switch over to said second position is coupled to cause said valve to reach said second position substantially at the time of impact.

12. Impact device according to claim 11, wherein said hammer piston (13) has a first drive surface (26) in a front pressure chamber (22) for effecting the return stroke and a second drive surface (25) in a rear pressure chamber (25) for effecting the impact stroke, said port of said first plurality of ports (38–41) being located to be opened to said front pressure chamber (22) when said first drive surface (26) passes said ports of said first plurality of ports during the return stroke of the hammer piston, and said ports of said second plurality of ports (43–46) being located to be opened to said rear pressure chamber (23) when said second drive surface (25) passes said ports of said second plurality of ports during the impact stroke of the hammer piston.

13. Impact device according to claim 8, wherein said hammer piston (13) has a first drive surface (26) in a front pressure chamber (22) for effecting the return stroke and a second drive surface (25) in a rear pressure chamber (25) for effecting the impact stroke, said port of said first plurality of ports (38–41) being located to be opened to said front pressure chamber (22) when said first drive surface (26) passes said ports of said first plurality of ports during the return stroke of the hammer piston, and said ports of said second plurality of ports (43–46) being located to be opened to said rear pressure chamber (23) when said second drive surface (25) passes said ports of said second plurality of ports during the impact stroke of the hammer piston.

14. Impact device according to any one of claims 5, 6 or 7, wherein said hammer piston (13) has a first drive surface (26) in a front pressure chamber (22) for effecting the return stroke and a second drive surface (25) in a rear pressure chamber (25) for effecting the impact stroke, said ports of said first plurality of ports (38–41) being located to be opened to said front pressure chamber (22) when said first drive surface (26) passes said ports of said first plurality of ports during the return stroke of the hammer piston, and said ports of said second plurality of ports (43–46) being located to be opened to said rear pressure chamber (23) when said second drive surface (25) passes said ports of said second plurality of ports during the impact stroke of the hammer piston.

* * * * *

UNITED STATES PATENT AND TRADEMARK OFFICE

CERTIFICATE OF CORRECTION

PATENT NO. : 4,413,687

DATED : November 8, 1983

INVENTOR(S) : Åke T. EKLÖF

It is certified that error appears in the above-identified patent and that said Letters Patent is hereby corrected as shown below:

COLUMN 4 (claim 1), line 29, after "for stroke length selection," change "the second" to --and second--;

COLUMN 5 (claim 4), line 1, after "said anvil means;" change "and" to --an--.

Signed and Sealed this

*Fifteenth* Day of *May 1984*

[SEAL]

*Attest:*

GERALD J. MOSSINGHOFF

*Attesting Officer*

*Commissioner of Patents and Trademarks*